US005584725A

United States Patent [19]

Tseng et al.

[11] Patent Number: 5,584,725

[45] Date of Patent: Dec. 17, 1996

[54] RETENTION POST FOR USE WITH CONNECTOR HAVING ELONGATED HOUSING

[75] Inventors: Gwou-Jong Tseng, Tu-Chen; C. T. Mou, Tainan; L. M. Poi, Tu-Chen, all of Taiwan

[73] Assignee: Hon Hai Precision Ind. Co., Ltd., Taiwan

[21] Appl. No.: 314,883

[22] Filed: Sep. 29, 1994

[51] Int. Cl.[6] ..... H01R 13/73

[52] U.S. Cl. ..... 439/572

[58] Field of Search ..... 439/567, 571, 439/572

[56] References Cited

U.S. PATENT DOCUMENTS 5,178,561 1/1993 Lindeberg et al. ..... 439/571

5,366,389 11/1994 Kreutter ..... 439/571

*Primary Examiner*—Gary F. Paumen

[57] ABSTRACT

An electrical connector (10) includes insulative elongated housing (12) and a plurality of contacts therein to electrically and mechanically connect a daughter board inserted in such connector (10) to a mother board (40) on which the connector (10) is seated. A pair of cavities (24) extend upwardly from a bottom surface (22) of the housing (12) proximate two opposite ends, in which a pair of corresponding posts (30) are installed. Each post (30) includes an upper retaining portion (32) embedded in such corresponding cavity (24) and a lower mounting portion (34) extending downwardly from the retaining portion (32) and adapted to be received within the corresponding hole (42) in the mother board (40). The mounting portion (34) of each post (30) has a cross-section of a circle without a segment wherein a secant of such segment of one post is designedly opposite to that of another post (30).

11 Claims, 6 Drawing Sheets

RETENTION POST FOR USE WITH CONNECTOR HAVING ELONGATED HOUSING

BACKGROUND OF THE INVENTION

1. Field of The Invention

The invention relates to retention posts for use with a connector, particularly to a pair of posts adapted to be attachably fastened to an elongated housing of the connector, and respectively positioned proximate two opposite ends in the lengthwise direction.

2. The Prior Art

Retention posts of the connector incorporating through-holes in the PC board is a very popular way to secure, temporarily and/or permanently, the connector onto the board. As known, the retention post or boardlock made of metal might have good resilience to comply with deviation of the corresponding hole in the PC board for easy operation, for example, U.S. Pat. Nos. 4,681,389, 4,795,353, 4,842,552, 4,907,987, 5,024,607, 5,083,926, 5,108,312, 5,171,165, 5,244,414, 5,295,862, and 5,316,500. Unfortunately, such metal retention post requires stamping and forming process in manufacturing such metal retention post, thus increasing the cost. Additionally, metal material of such retention post is relatively more expensive than plastic material. Using the plastic post integral with the connector housing naturally is much cheaper than using the metal one, but stiffness of plastic tends to preclude deviation of position of the hole in the PC board. Anyhow, some computer manufacturers intend to use the inexpensive plastic retention post integral with the connector housing for saving cost, but still allowing reasonable deviation of the hole in the PC board. Most achievements in designing such plastic retention post are to try to reform the post for increasing resilience thereof in compliance with the deviated hole in the PC board, for example, U.S. Pat. Nos. 5,071,371 (claim 25), 5,302,134, 5,312,642, 5,334,647, 5,328,389, 5,336,110, 5,336,111, and the patent application of Ser. No. 07/929,087 filed Aug. 12, 1992.

In fact, most cases of incompatibility between the retention post of the connector and the hole in the PC board, result from warp of the housing of the connector in the lengthwise direction wherein such warp is due to shrinkage of such plastic material of the connector housing after molding process. In other words, the cold molded connector tends to be somewhat a bow-shape as shown in FIG. 1. This is the reason why in some designs, the lengthwise connector housing 2 has a center post 6 at the bottom which designedly engages a central hole 7 in the board 5 for pulling the central portion of the housing downwardly for maintaining the whole housing 2 to be fully seated on the PC board 5. From another viewpoint, because of warp of the housing 2 along such lengthwise direction of the housing 2, the centerline of the two retention posts 3 positioned proximate two opposite ends of the housing 2, is naturally moved closer to each other than those of the original design specification. Understandably, these two closer posts 3 of the connector housing 2 do not comply with the corresponding holes 4 in the PC board 5 which are located in the normal position according to the specification.

An object of the invention is to provide the connector with a post device made of the inexpensive plastic material wherein such post device can be conformably received in the corresponding hole in the PC board, on which such connected is mounted, even though there is a warp of the connector housing along its lengthwise direction.

Another object of the invention is to provide the connector with a post device made of the inexpensive plastic material wherein such post device can be detachably attached to the connector housing. As well known, the conventional plastic post integral with the housing is easily broken during shipping or handling due to its tiny dimension and its stiffness. Commonly, the whole connector should be abandoned in such situation because the damaged post is integrally molded with the connector housing. In the invention, only replacing the damaged post can be applied thereto, thus saving the cost. From another viewpoint of engineering, the post can be made by heat-resistant material rather than the common material used in the connector housing, thus being able to meet the requirements of the characters of the whole connectors, i.e., the strength and the heat-resistance of the post, and the appropriate stiffness and/or elasticity of the housing. It can be understood that in the conventional plastic post connector which includes the integral post, applying the stiff material as the post to the whole connector housing not only costs money, but also results in the problem of shortness or brittleness of the housing which is not suitable for the contacts in an interference therein. In contrast, through the present invention, the post and the housing can be respectively made of the proper plastic material different from each other to meet the respective mechanical requirements and to save the whole set's cost.

SUMMARY OF THE INVENTION

According to an aspect of the invention, an electrical connector includes insulative elongated housing and a plurality of contacts therein to electrically and mechanically connect a daughter board inserted in such connector to a mother board on which the connector is seated. A pair of cavities extend upwardly from a bottom surface of the housing proximate two opposite ends, in which a pair of corresponding posts are installed. Each post includes an upper retaining portion embedded in such corresponding cavity and a lower mounting portion extending downwardly from the retaining portion and adapted to be received within the corresponding hole in the mother board. The mounting portion of each post has a cross-section of a circle without a segment wherein a secant of such segment of one post is designedly opposite to that of another post.

DETAILED DESCRIPTION OF THE PREFERRED EMBODIMENT

References will now be made in detail to the preferred embodiments of the invention. While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
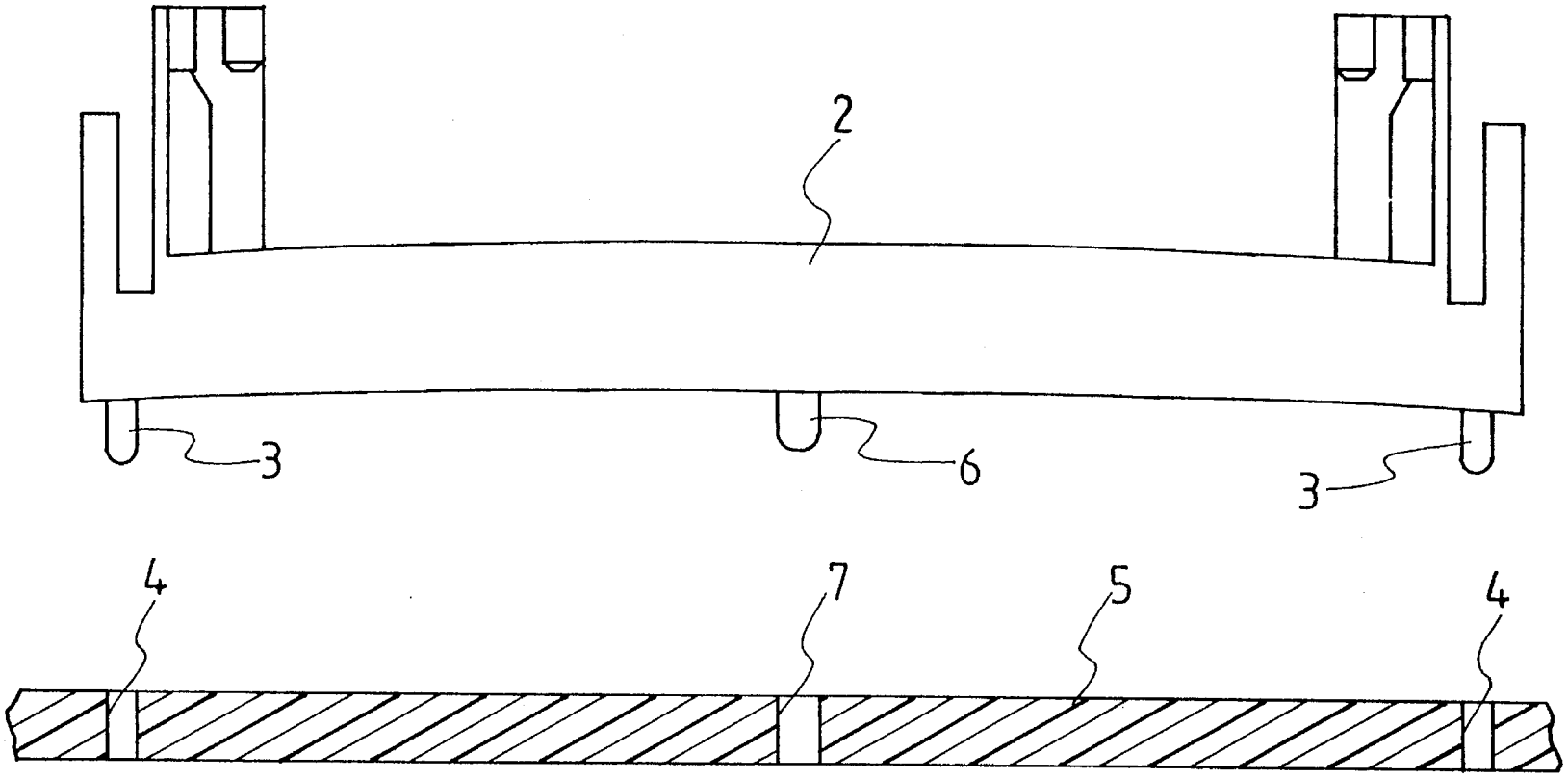
FIG. 1 (PRIOR ART)
FIG. 1 is a front view of the prior art to show, in exaggeration, a warp along the lengthwide direction of the connector housing.
Figure 2:
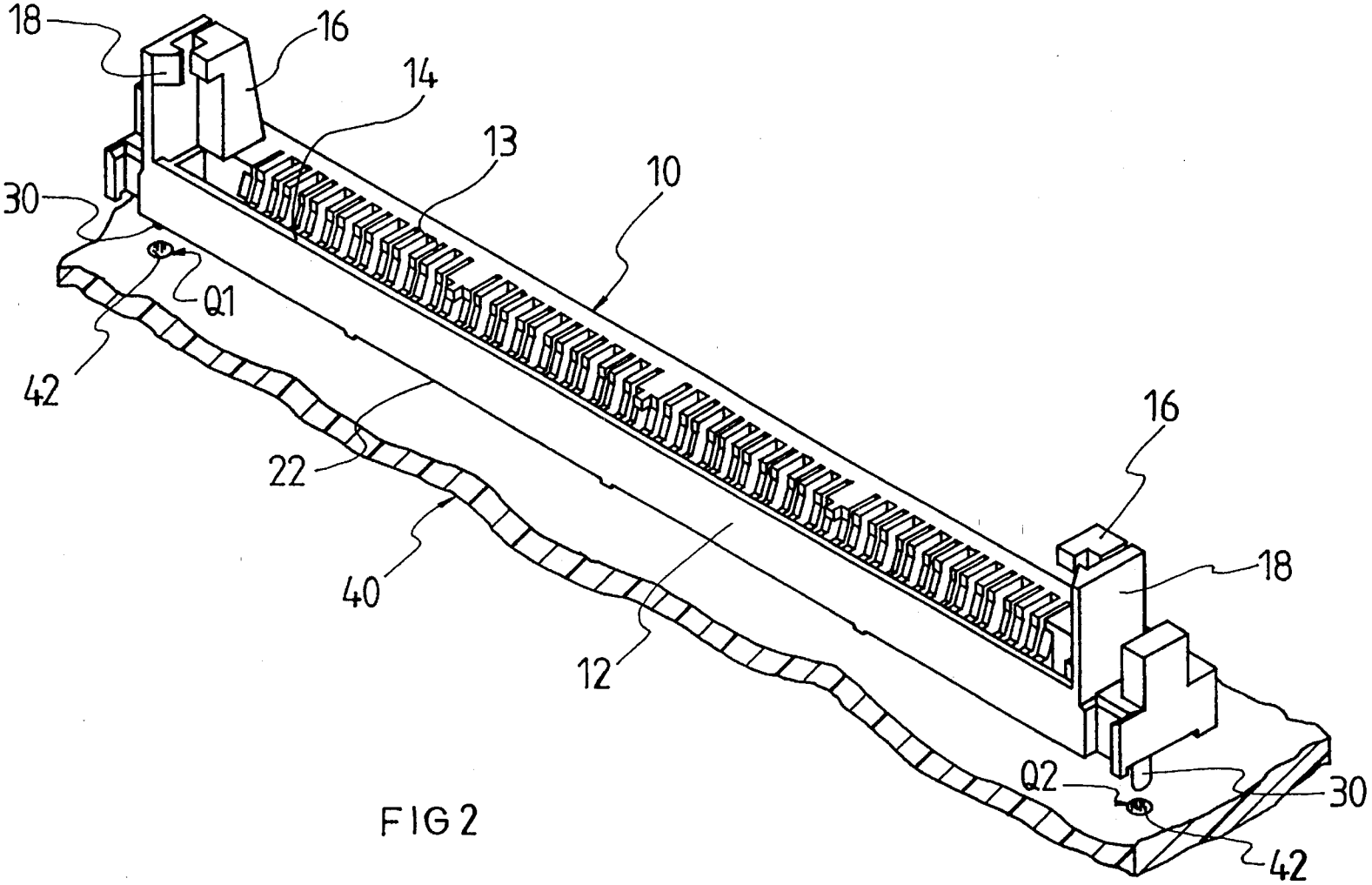
FIG. 2 is a perspective view of an electrical connector having an insulative elongated housing mounted on a mother board, with two plastic posts retainably engaged within a pair of holes in the board, according to the present invention.

It will be noted here that for a better understanding, like components are designated by like reference numerals throughout the various figures in the embodiment. Attention is now directed to FIG. 2 wherein a SIMM (single in-line memory module) socket connector 10 has an insulative elongated housing 12 and an elongated slot 14 extending therein lengthwise. A plurality of cavities 13 are positioned along two sides of the slot 14 for receiving a plurality of corresponding contacts (not shown) therein for engagement with the circuit pads on the daughter board (not shown) of which the bottom edge is inserted within the slot 14 and for engagement with pads or holes of the mother board 40 on which the connector 10 is seated. The housing 12 further includes a pair of pegs 16 proximate two ends of the slot 14 for supporting and restraining the inserted daughter board in position. Another pair of latches 18 are positioned on the outer sides of the pegs 16, respectively, for latchably retaining the inserted daughter board without the risk of reversible rotation when the daughter board is in the fixed position, i.e., the vertical position.

Figure 3A:
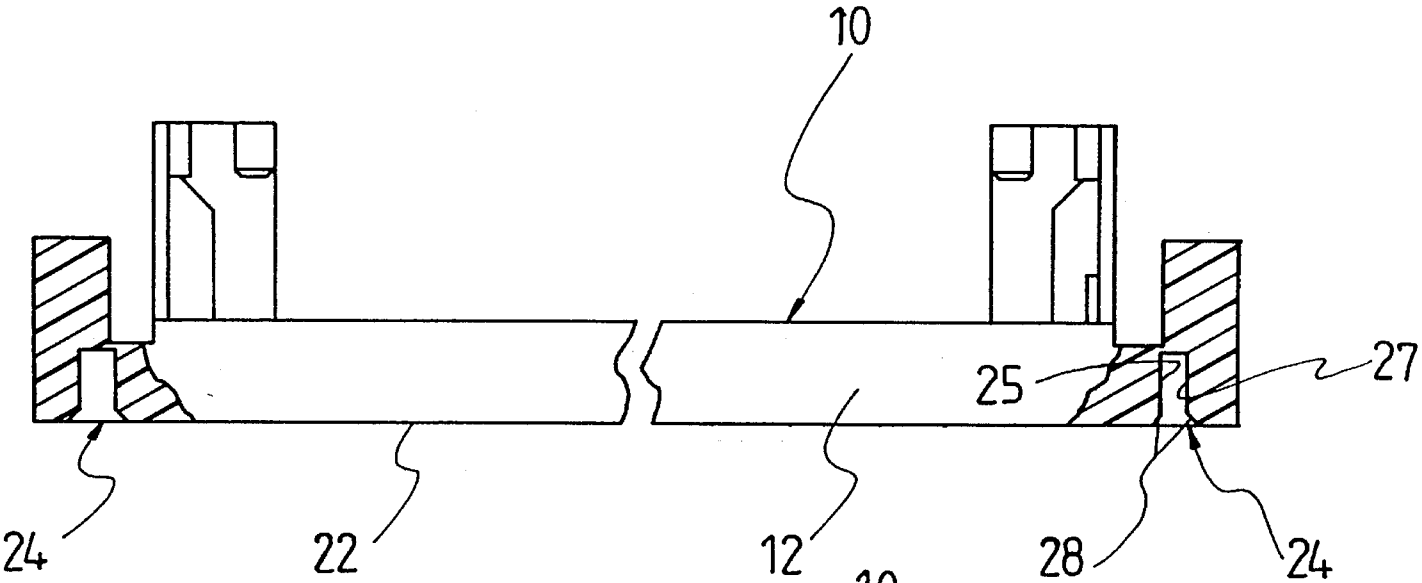
FIG. 3(A) is a front view of the connector of FIG. 2 with a fragmental cross-section view thereof to show the cavities therein.
Figure 3B:
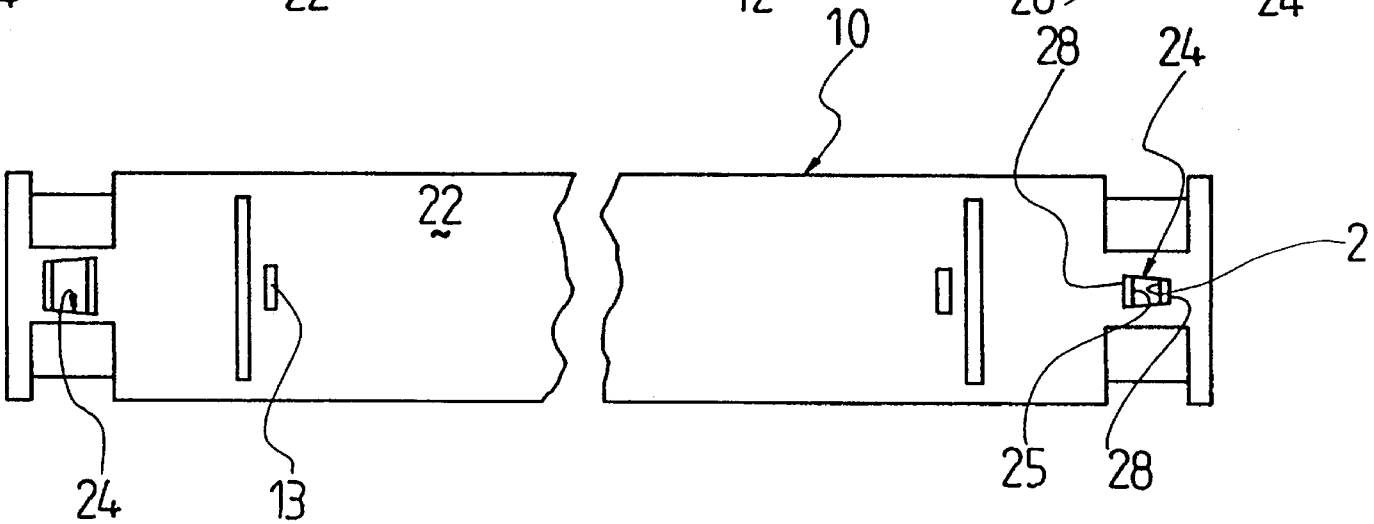
FIG. 3(B) is a bottom view of the connector of FIG. 2 to the cross-sectional shape of the cavity of the housing.
Figure 4:
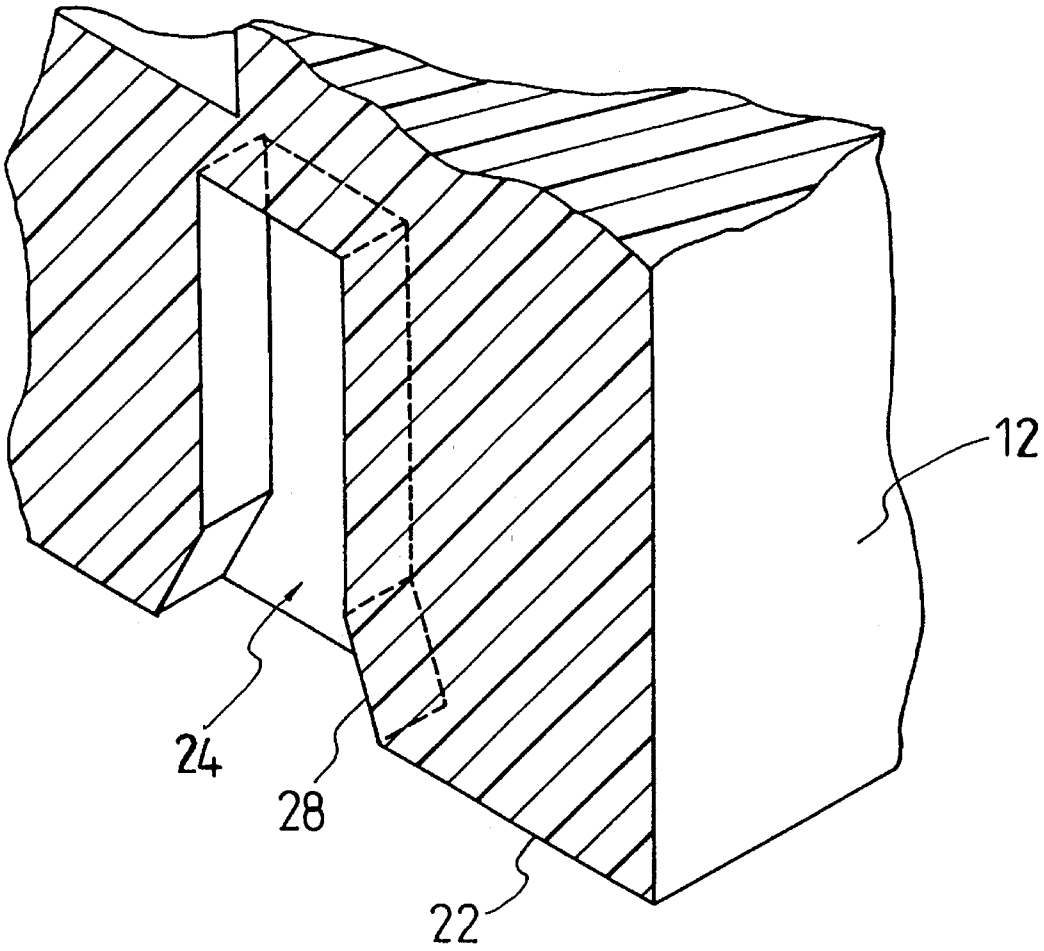
FIG. 4 is a fragmentary cross-sectional view of the housing, cut-away along line X—X of FIG. 3(B) to show the cavity in the housing.
Figure 5:
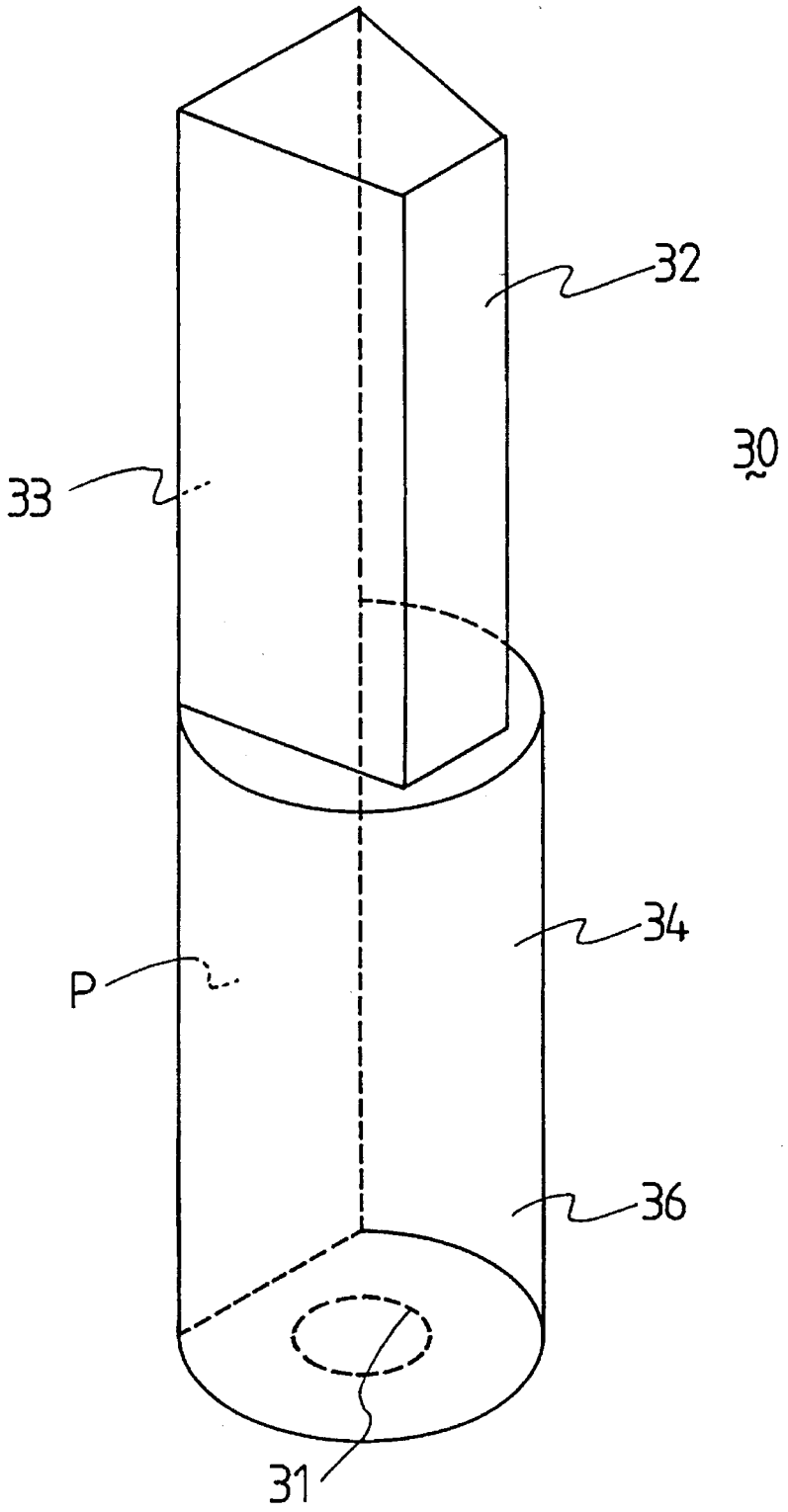
FIG. 5 is a perspective view of the (right) post of the connector of FIG. 1.
Figure 7A:
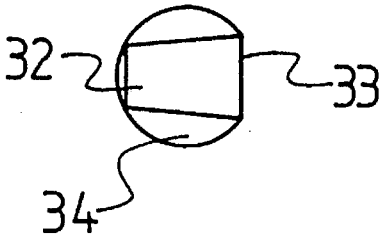
FIG. 7(A) is a top view of the left post of the connector of FIG. 1.
Figure 6A:
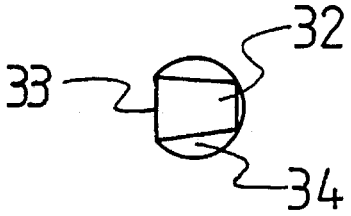
FIG. 6(A) is a top view of the right post of the connector of FIG. 1.
Figure 7B:
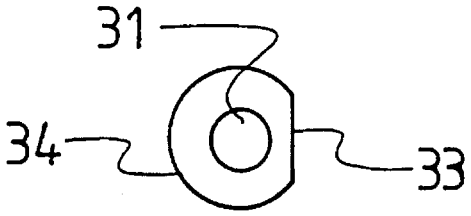
FIG. 7(B) is a bottom view of the left post of the connector of FIG. 1.
Figure 6B:
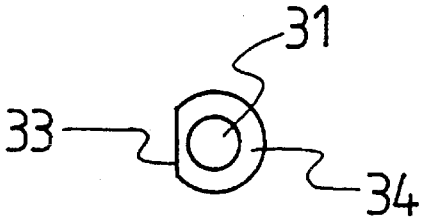
FIG. 6(B) is a bottom view of the right post of the connector of FIG. 1.
Figure 7C:
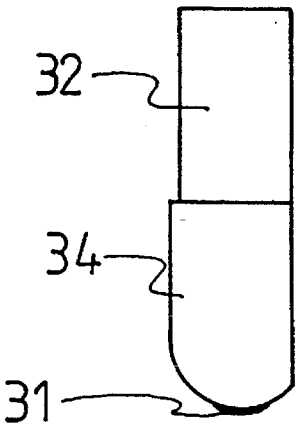
FIG. 7(C) is a front view of the left post of the connector of FIG. 1.
Figure 6C:
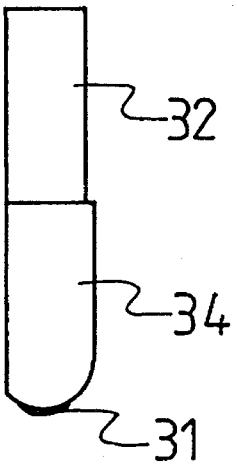
FIG. 6(C) is a front view of the right post of the connector of FIG. 1.

The feature of the invention focuses on the mounting post 30 under the bottom surface 22 of the housing 12. As shown in FIG. 3 (A), 3(B) and 4, proximate each end of the housing 12, a cavity 24 is recessed from the bottom surface 22 inwardly, i.e., upwardly. Each cavity 24 includes a cross-section of an isosceles trapezoid having a pair of parallel sides perpendicular to the lengthwise outer one 27. Two chamfers 28 are respectively disposed on these two parallel sides 25, 27 around the opening 28 of each cavity 24.

Referring to FIG. 5, 6(A)–6(C) and 7(A)–7(C), correspondingly, a post 30 is adapted to be retainably received in each cavity 24. The post 30 includes an upper retaining portion 32 and a lower mounting portion 34 wherein the retaining portion 32 has a similar cross-section of the isosceles trapezoid with the cavity 24 for retainably and conformably being embedded within the cavity 24 in an interference fit. The mounting portion 34 includes a generally cylindrical body 36 with a segment portion thereof (not shown) being therefrom removed along a secant plane P which is coplanar with the surface 33 of the retaining portion 32 wherein such plane P is substantially perpendicular to the axis along the lengthwise direction of the housing 12, and is facing the center of the housing 12.

Also referring to FIG.2, it can be seen that the planes P of the opposite two posts 30 are opposite to each other, and the distance between such two opposite planes P of the posts is substantially larger than that between two closest points Q1 and Q2 of the peripheries of the two corresponding holes 42 in the mother board 40 on which the connector 10 is mounted and the posts 30 are designedly received in the corresponding holes 42, respectively. Therefore, even though there exists a miner warp along the lengthwise direction of the housing 12 of the connector 10 to result in substantial reduction of the predetermined distance between two tip sections 31 of the posts 30, the mounting portions 34 of the posts 30 may still be allowed to be inserted into the holes 42 in the board 40 due to secant planes P of such two posts 30. In other words, the remaining body 36 are still positioned in the region of the corresponding hole 42 in the board 40. Accordingly, such minor misalignment of the posts 30 of the connector 10 with regard to the corresponding holes 42 in the board 40 can be compensated, and the posts 30 can be inserted into the holes 42 for soldering the connector 10 on the board 40.

It can be understood that in this embodiment, two opposite posts 30 are of different sizes which are standardized for conforming to the industrial specification for polarization of the connector 10 on the mother board. Understandably, the cross-section of the isosceles trapezoid in the cavity 24 and the similar configuration of the retaining portion 32 of the post 30 also provide polarization function between these two items for assuring that the secant plan P of each post 35 faces inwardly for compensation of lengthwise shrinkage of the housing 12 of the connector 10. In contrast, if the material of the housing 12 intends to increase its dimension in the lengthwise direction after molding, such secant plane P may be positioned on the outer side of each post 30 for compensation such expansion. Anyhow, the remaining body 36 of the mounting portion 34 should maintain the substantial enough dimension for engagement with the corresponding hole 42 in the board 40 in an interference fit regardless of any misalignment therebetween existing, i.e., the warp of the housing 12.

It is also appreciated that the coplanarity between the plane P of the post 30 and the surface 33 of retaining portion 32 of the post 30 can prevent concentration of stress around the intersection section thereof when the forces are applied to the plane P by the engagement of the post 30 with the corresponding periphery of the hole 42 in the board 40. It is also contemplated that such pair of chamfers 28 of the cavity 24 around the opening 28 in the lengthwise direction along housing 12 can not only provide guidance of insertion of the retaining portion 32 of the post 30 into the cavity 24, but also prevent concentration of stress thereabout when a deflection of the post 30 occurs in the lengthwise direction due to misalignment of the post 30 with regard to the hole 42. It is also seen that in the present invention the length of the post 30 is almost twice that of the conventional plastic post integral with the housing because the conventional plastic post generally integrally extending downwardly from the bottom surface of the housing, but the retaining portion 32 of the post 30 in this invention can be embedded within the cavity 24 in the housing 12. In comparison with the prior art plastic post, the increasing length of the post 30 in the present invention provides better resilience thereof for allowing more tolerance of the position of the corresponding hole.

It can be noted that the cross-section of the isosceles trapezoid in the cavity 24 is only one embodiment of the invention which limits the retaining portion 32 of the post 30 to be inserted into such cavity 24 in only one direction, and thus assures polarization of the mounting portion 34 of the post 30, i.e., the secant plane P facing the center of the housing 12. Understandably, other appropriate polygons can be used to define such cavity 24 and cooperate with the conformable retaining portion 32 of the post 30 to retainable polarize the post therein, and thus the secant planes P of the two spaced posts 30 respectively positioned proximate two ends of the housing 12, can face to each other for compensating warp of the housing 12.

It can be understood that most prior arts use the thinner or hollow structures of the plastic posts to achieve a greater resilience for curing the dimension or position difference between the post and the hole, while such resilient structure may jeopardize the strength thereof and tends to be damaged during shipping or handling. Differently, in the present embodiment, the post 30 is of solid type which can efficiently resist the external impact. Additionally, as aforementioned, even though the post of the connector is broken, it is easy, by tools, to withdraw the damaged post out of the cavity of the connector housing and substitutably insert a new one thereunto. Accordingly, it is not necessary to discard the whole set connector as the prior arts which have the integral posts thereof, thus saving money. Similarly, it may be required only to change the post design when there is a dimension-varied mounting holes in the mother board to cooperate with the original housing design. In other words, only a small die is required for making such changeable different post. In contrast, in this situation, in the conventional connector having the integral post, a new whole die to make the whole connector is required, thus costing money. As aforementioned, another advantage of this invention is to be able to use an inexpensive material to make the whole connector housing and to use an expensive material to make the post which needs to resist the high temperature, thus reducing the cost.

While the present invention has been described with reference to a specific embodiment, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An electrical connector for mounting on a PC board, comprising:

an insulative elongated housing having a plurality of contacts therein for electrically connecting an circuit device to said PC board;

a pair of posts extending downwardly proximate two opposite ends of the housing, each post including a lower mounting portion for reception within a hole in said PC board, each said mounting portion including a continuously round cylindrical body with a segment portion removed therefrom, thus forming a secant plane thereon facing to a center of the housing and perpendicular to a lengthwise direction of the housing so that said two secant planes of said two posts are opposite to each other for compensation of misalignment of the posts with regard to the holes in said PC board due to warp of housing.

2. The electrical connector as described in claim 1, wherein said pair of posts can be detachably attached to said housing.

3. The electrical connector as described in claim 2, wherein corresponding to said pair of posts, a pair of cavities extend inwardly from a bottom surface of the housing proximate said two opposite ends of the housing, and each post further includes an upper retaining portion for being retainably embedded within the corresponding cavity.

4. The electrical connector as described in claim 2, wherein each cavity has a cross-section of an isosceles trapezoid for retainably receiving the conformable retaining portion of the post therein.

5. The electrical connector as described in claim 4, wherein a pair of parallel sides of said cross-section of the isosceles trapezoid are perpendicular to the lengthwise direction of the housing, and a pair of chamfers are respectively positioned on said pair of sides around an opening of said cavity.

6. The electrical connector as described in claim 2, wherein said secant plane of the mounting portion of each post is coplanar with a surface of the retaining portion of the post.

7. A post for use with an electrical connector which is adapted to be mounted onto a PC board, said post being made of insulative material and comprising:

an upper retaining portion adapted to be interferentially received within a cavity of said connector; and a lower mounting portion adapted to be interferentially engaged within a corresponding hole in said PC board, wherein said mounting portion of the post has a generally continuously round cylindrical body with a segment portion removed therefrom, thus forming a secant plane thereon.

8. The post as described in claim 7, wherein said post is substantially of a solid type without any hollow section therein.

9. The post as described in claim 7, wherein said retaining portion of the post includes a polygonal cross-section for reception in said cavity having a corresponding configuration.

10. The post as described in claim 9, wherein said retaining portion of the post can be received in said cavity in the housing in only one direction to polarize the installation of the post, of which a secant plane is formed on the mounting portion.

11. A post for use with an electrical connector which is adapted to be mounted onto a PC board, said post being made of insulative material and comprising:

an upper retaining portion adapted to be interferentially received within a cavity of said connector; and a lower mounting portion adapted to be interferentially engaged within a corresponding hole in said PC board, wherein said retaining portion of the post includes a cross-section of isosceles trapezoid whereby a surface is defined by one of a pair of parallel sides thereof, and said surface is coplanar with a secant plane of the mounting portion of the post.

* * * * *